US011793701B2

(12) United States Patent
Lindqvist et al.

(10) Patent No.: US 11,793,701 B2
(45) Date of Patent: Oct. 24, 2023

(54) DEVICE FOR BEARING THE WEIGHT OF A LOAD

(71) Applicant: Roland John Lindqvist, Berwick (AU)

(72) Inventors: Roland John Lindqvist, Berwick (AU); Perry John Underwood, Lake Cathie (AU)

(73) Assignee: Roland John Lindqvist

( * ) Notice: Subject to any disclaimer, the term of this patent is extended or adjusted under 35 U.S.C. 154(b) by 468 days.

(21) Appl. No.: 16/757,997

(22) PCT Filed: Oct. 24, 2018

(86) PCT No.: PCT/AU2018/051151

§ 371 (c)(1),
(2) Date: Apr. 21, 2020

(87) PCT Pub. No.: WO2019/079854

PCT Pub. Date: May 2, 2019

(65) Prior Publication Data

US 2020/0337921 A1 Oct. 29, 2020

(30) Foreign Application Priority Data

Oct. 24, 2017 (AU) ..... 2017904309

(51) Int. Cl.
*A61G 7/10* (2006.01)
*B66D 5/34* (2006.01)

(52) U.S. Cl.
CPC ..... *A61G 7/1015* (2013.01); *B66D 5/34* (2013.01); *B66D 2700/05* (2013.01)

(58) Field of Classification Search
CPC .. A61G 7/1015; A61G 7/1078; A61G 7/1042; A61G 7/1044; A61G 7/1046; A61G 7/1051; A61G 7/1061; A61G 7/1063; A61G 1/003; A61G 2200/327; A61G 2200/34; B66D 5/34; B66D 2700/05; B66D 3/16;

(Continued)

(56) References Cited

U.S. PATENT DOCUMENTS 3,365,075 A * 1/1968 Adrianus ..... B63B 23/40 254/288
3,516,642 A * 6/1970 Durand ..... B66D 3/14 254/335

(Continued)

FOREIGN PATENT DOCUMENTS

FR 2974797 A1 11/2012

*Primary Examiner* — David R Hare
*Assistant Examiner* — Luke Hall
(74) *Attorney, Agent, or Firm* — Morriss O'Bryant; Compagni Cannon PLLC.

(57) ABSTRACT

There is provided a weight bearing device for being located overhead to support the weight of a load applied to the device in use. Embodiments comprise a reel for winding up or unwinding a support belt for supporting the load, the reel being rotatable about a first axis of rotation. An actuator element is provided for being driven about a second axis of rotation to drive a locking mechanism to lock the reel against unwinding of the support belt when the weight of the load is applied to the support belt. The reel is released by the locking mechanism when the weight of the load is removed from the support belt. Methods for use of the device are also provided.

23 Claims, 7 Drawing Sheets

(58) Field of Classification Search
CPC .... B66D 5/20; B66D 1/04; B66D 2700/0191; B66D 2700/0108; B66D 2700/015; B66D 2700/07
USPC ..... 5/88.1
See application file for complete search history.

(56) References Cited

U.S. PATENT DOCUMENTS 3,589,641 A * 6/1971 Lawrence ..... B66D 1/36 242/157.1
4,757,954 A * 7/1988 Doty ..... B60R 22/41 280/806
4,773,613 A * 9/1988 Kawai ..... B60R 22/41 242/381.4
4,940,193 A * 7/1990 Grabowski ..... B60R 22/34 297/475
4,947,497 A * 8/1990 Marchand ..... A61G 7/1051 5/86.1
5,101,519 A * 4/1992 Yamamoto ..... A61G 7/1084 5/942
5,544,838 A * 8/1996 Boelstler ..... B60R 22/405 242/384.2
5,553,335 A * 9/1996 Lahtinen ..... A61G 7/1015 5/88.1
5,588,612 A * 12/1996 Laun ..... B60R 22/41 242/383.1
2002/0166999 A1* 11/2002 Topping, Jr. ..... B66D 5/34 254/376
2006/0169957 A1* 8/2006 Gilman ..... B66D 3/02 254/222
2007/0289064 A1* 12/2007 Martin ..... A61G 5/1083 5/618
2009/0121204 A1 5/2009 Guyard
2010/0043140 A1* 2/2010 Chepurny ..... B66D 3/18 5/85.1
2010/0071129 A1* 3/2010 Yokota ..... A61G 7/1055 5/83.1
2010/0270252 A1* 10/2010 Chepurny ..... A61G 7/1061 212/76
2015/0014613 A1* 1/2015 Horndacher ..... B66D 5/34 254/267
2016/0000625 A1* 1/2016 Duquette ..... A61G 7/1078 5/88.1
2017/0152126 A1* 6/2017 Dube ..... B66B 9/00

* cited by examiner

DEVICE FOR BEARING THE WEIGHT OF A LOAD

FIELD OF THE INVENTION

The present invention relates to device for bearing the weight of a load. One or more embodiments have application to facilitating raising, lifting and/or carrying the load. Methods for providing the device and for using the device are also described herein.

BACKGROUND TO THE INVENTION

Hoisting devices have widespread use in hospitals, aged care facilities and private settings for facilitating the raising or lifting of person(s). Such hoisting devices can be mounted overhead to support frames, to a ceiling fixture, or to track systems secured to the ceiling for the hoist for being rolled along the track on rollers of the hoisting device. Hoisting devices are, for instance, disclosed in International Application Publication No. WO 2005/041838. These hoisting devices comprise an electrically operated hoist module for connection to a trolley mounted on an overhead track. The trolley has rollers for allowing the trolley to be rolled along the track, and the hoist module is first connected to the trolley via a wire cable. The hoist module is then raised to the trolley by either operation of a reel of the module to wind up the wire cable whereby the module is drawn up the wire cable or in another form, it appears the wire cable is wound onto a manual reel and the module pulled up to the trolley. A strap hangs from the hoist module to which a lifting bracket is coupled. The strap can be drawn up or lowered by the hoisting module to raise or lift the lifting bracket. In use, a sling or the like for fitting about a person can be carried by the lifting bracket.

SUMMARY OF THE INVENTION

In an aspect of the invention there is provided a weight bearing device for being located overhead to support the weight of a load applied to the device in use, the device comprising:

a reel for winding up or unwinding a support belt for supporting the load, the reel being rotatable about a first axis of rotation;

a locking mechanism for locking the reel against rotation about the first axis of rotation and thereby unwinding of the support belt; and an actuator element for being driven about a second axis of rotation to drive the locking mechanism to lock the rotation of the reel when the weight of the load is applied to the support belt, and wherein the reel is released by the locking mechanism when the weight of the load is removed from the support belt.

In at least some embodiments of the invention, the support belt can be provided separately for being fitted to the reel for winding up or unwinding of the support belt by the reel.

Typically, the support belt when fitted to the device hangs from the reel and wraps about one side of the actuator element for applying the force to the actuator element to drive the actuator element about the second axis of rotation.

Typically, the device further comprises a pulley wheel for being rotated drive rotation of the reel to wind up or unwind the support belt in the absence of the weight of the load being applied to the support belt, and a pulley belt passing about the pulley wheel and arranged for being pulled to drive the rotation of the pulley wheel. Typically, the pulley wheel is arranged to rotate about the first axis of rotation.

Typically, the locking mechanism comprises:

at least one ratchet wheel arranged to rotate about the first axis of rotation with the rotation of the reel; and at least one pawl pivotable about the second axis of rotation into engagement with the ratchet wheel to lock the reel.

Typically, the actuator element is disposed in an offset position with respect to the second axis of rotation and is arranged to be driven about the second axis of rotation with application of force to the actuator element by the support belt upon the weight of the load being applied to the support belt, and wherein the pawl is located to be driven into engagement with the ratchet wheel by the rotation of the actuator element about the second axis of rotation.

Typically, the first axis of rotation is defined by a rotatably mounted main shaft, and the reel and the pulley wheel are fixedly mounted on the main shaft.

Typically, the second axis is defined by a rotatably mounted ancillary shaft, and the pawl and the lever arm are fixedly mounted on the further shaft.

Typically, the actuator element comprises a shaft member, and an end region of the at least one pawl is mounted to the shaft member for driving the pawl about the second axis of rotation when the shaft member is driven about the second axis of rotation.

In at least some embodiments, the ratchet wheel is disposed in abutment with the reel.

Typically, a device embodied by the invention further comprises a damping system for damping the locking of the reel by the locking mechanism. Most typically, the damping system is configured to drive disengagement of the locking mechanism to permit rotation of the reel for unwinding of the belt from the reel, when the weight of the load is removed from the support belt.

Typically, the damping system comprises a lever arm for being rotated in one direction about the second axis of rotation to a working position when the actuator element is driven about the second axis by the support belt, and the lever arm is biased against said rotation into its working position to thereby dampen the engagement of the ratchet wheel by the pawl. In particularly preferred embodiments, the damping system further comprises a pair of permanent magnets arranged for being moved relative to one another into a magnetically repelling relationship to bias the lever arm against rotation into its working position. Generally, one of the magnets is disposed for being moved into the magnetically repelling relationship with the other one of the magnets with the rotation of the lever arm, the magnetic repulsion between the magnets being sufficient to drive the magnets apart to rotate the lever arm about the second axis of rotation in an opposite direction to disengage the pawl from engagement with the ratchet wheel upon the weight of the load being removed from the support belt.

By damping the rotation of the at least one pawl into engagement with the ratchet wheel, smooth operation of the device may be obtained and sudden "jolting" as the pawl engages the ratchet wheel avoided or minimised, thereby also minimising wear and the risk of damage to the device.

Typically, the device comprises a pair of ratchet wheels and a pair of pawls, and each said pawl is arranged to engage with a corresponding one of the ratchet wheels, respectively. In such embodiments, the reel is typically disposed between the ratchet wheels.

In another aspect of the invention there is provided a weight bearing device for being located overhead to support the weight of a load applied to the device in use, the device comprising:

a support belt for supporting the load;

a reel for winding up or unwinding the support belt, the reel being rotatable about a first axis of rotation;

at least one ratchet wheel arranged to rotate about the first axis of rotation with the rotation of the reel;

at least one pawl pivotable about a second axis of rotation;

an actuator element disposed in an offset position with respect to the second axis of rotation and arranged to driven about the second axis of rotation by application of force to the actuator element by the support belt when the weight of the load is applied to the support belt, the pawl being located to be driven into engagement with the ratchet wheel with the rotation of the actuator element about the second axis of rotation to lock the reel against rotation about the first axis of rotation and thereby unwinding of the support belt;

at least one pair of permanent magnets; and a lever arm for being rotated in one direction about the second axis when the actuator element is driven about the second axis by the support belt, and one of the permanent magnets is disposed for being moved into a magnetically repelling relationship with the other one of the magnets with the rotation of the lever arm to dampen the engagement of the ratchet wheel by the pawl, the magnetic repulsion between the magnets being sufficient to drive the magnets apart to rotate the lever arm about the second axis of rotation in an opposite direction to disengage the pawl from the ratchet wheel upon the weight of the load being removed from the support belt.

Typically, in embodiments of the invention the one said magnet is mounted to the lever arm. Most typically, the other one of the magnets is mounted in a fixed position.

Typically, the support belt for supporting the load of a device embodied by the invention includes a coupling component on a free end of the support belt for coupling of a load bearing element to the support belt.

In at least some embodiments of a device of the invention, the device is configured for being mounted to a ceiling of a room. In particularly preferred forms, the device can be mounted to the ceiling via a track secured to the ceiling, and the device further comprises one or more rollers for permitting rolling of the device along the track on the rollers allowing the device to be moved about the room. Most typically, the device comprises at least one pair of opposed rollers for rolling along the track.

In another aspect there is provided a method of providing a weight bearing device embodied by the invention, the method comprising:

providing the support belt for supporting the load; and fitting the support belt to the reel of the device for winding up or unwinding of the support belt by the reel.

In another aspect there is provided method for providing a weight bearing device embodied by the invention, comprising;

providing the support belt for supporting the load;

providing a coupling component for coupling a load bearing element to the support belt for bearing of the load by the load bearing element; and fitting the coupling component to a free end of the support belt.

In embodiments in accordance with this aspect of the invention in which the support belt for supporting the load is provided separately from the device, the method further comprises fitting the support belt to the reel of the device for winding up or unwinding of the support belt by the reel. In other embodiments in which the support belt is provided already fitted to the reel, the coupling component can be fitted to the support belt with the device in situ, or the coupling component can be fitted to the support belt and the device can then be mounted in position (e.g., mounted on a track secured to the ceiling of a room) for use of the device.

Typically, the coupling component is configured to mate with a connector of the load bearing element.

In another aspect of the invention there is provided a method for raising and/or carrying a load, comprising:

providing a weight bearing device embodied by the invention; and raising and/or lifting the load whilst using the device of the invention to support the load via the support belt of the device.

The load bearing element for being coupled to the support belt of a device in accordance with the invention, or which is coupled to the support belt, can for instance, be a hoist for facilitating the raising and/or carrying of the load.

Typically, in embodiments of the invention the load is a person.

Advantageously, in embodiments as described herein, the support belt of the device can be lowered to a required height when the device is mounted in position overhead to allow attachment of the load bearing element. For instance, where a person is unable to leave the bed on their own accord or it is undesirable for them to do so, it may be necessary to lift the person entirely from the bed to a chair or trolley, or to move them whilst raised to another location, for e.g., treatment, therapy, showering and/or making the bed up with fresh bed sheets or linen. In such instances, the support belt of the device can be lowered to a required height to allow an extended belt of a hoist to be coupled to the support belt for operation of the hoist to climb its extended belt for raising of the hoist and thereby the person using e.g., a sling or harness located about the person and coupled to the hoist as is conventionally known. As will be understood, the reel of the device of the invention locks against rotation so that the support belt is unable to unwind from the reel once sufficient weight of the hoist is applied to the support belt to activate the locking mechanism of the device. The person may be raised in a seated or reclined position depending on the type of sling or harness utilised.

Various electrically operated hoists that may be used in combination with a device embodied by the invention are known to the skilled addressee. Such electrical hoists may be remotely controlled or be controlled via a control pad connected to the hoist by a cable.

Rather than being mounted to a ceiling directly or via a track system secured to the ceiling, in other embodiments the device can be mounted overhead to any suitable support, such a moveable or fixed position support or support frame.

Accordingly, devices embodied by the invention in one or more forms have versatility of application and are robust in form. Further, they can offer a cost effective means for supporting the weight of a load such as during the lifting and/or raising of a person as described above.

The device and methods of the invention have particular application in hospitals, aged care facilities, and private settings where facilitated raising, lifting and/or moving about of aged, injured, infirm or other patient(s) or person(s) is required. However, the invention is not limited to use with people and also has zoological or veterinary use in instances where lifting and/or moving of larger animals (e.g., such as dogs, sheep, goats, horses and members of the ape family) is needed, such as following an examination or a surgical operation where the animal needs to be lifted back onto its paws or hooves, and/or be moved from an examination or surgical table to a trolley, cart or recovery area.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers, integers or steps.

Any discussion of documents, acts, materials, devices, articles or the like that has been included in this specification is solely for the purpose of providing a context for the invention. It is not to be taken as an admission that any or all of these matters form part of the prior art base or were common general knowledge in the field relevant to the invention as it existed in Australia or elsewhere before the priority date of this application.

The features and advantages of the present invention will become further apparent from the following detailed description of exemplary embodiments of the invention together with the accompanying drawings.

BRIEF DESCRIPTION OF THE ACCOMPANYING DRAWINGS

DETAILED DESCRIPTION OF EXEMPLARY EMBODIMENTS OF THE INVENTION

Figure 4:
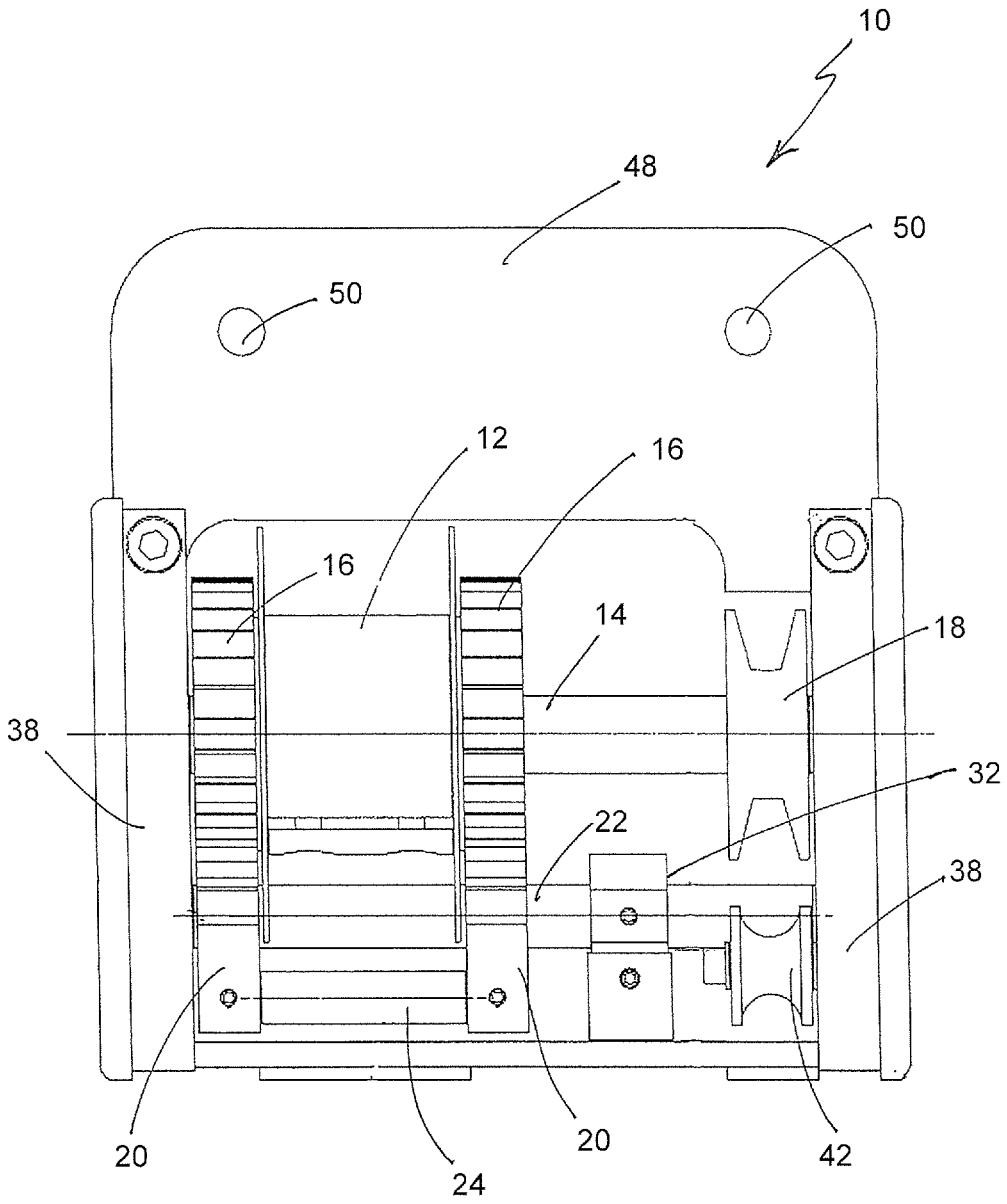
FIG. 4 is a front view of the device of FIG. 1
Figure 5:
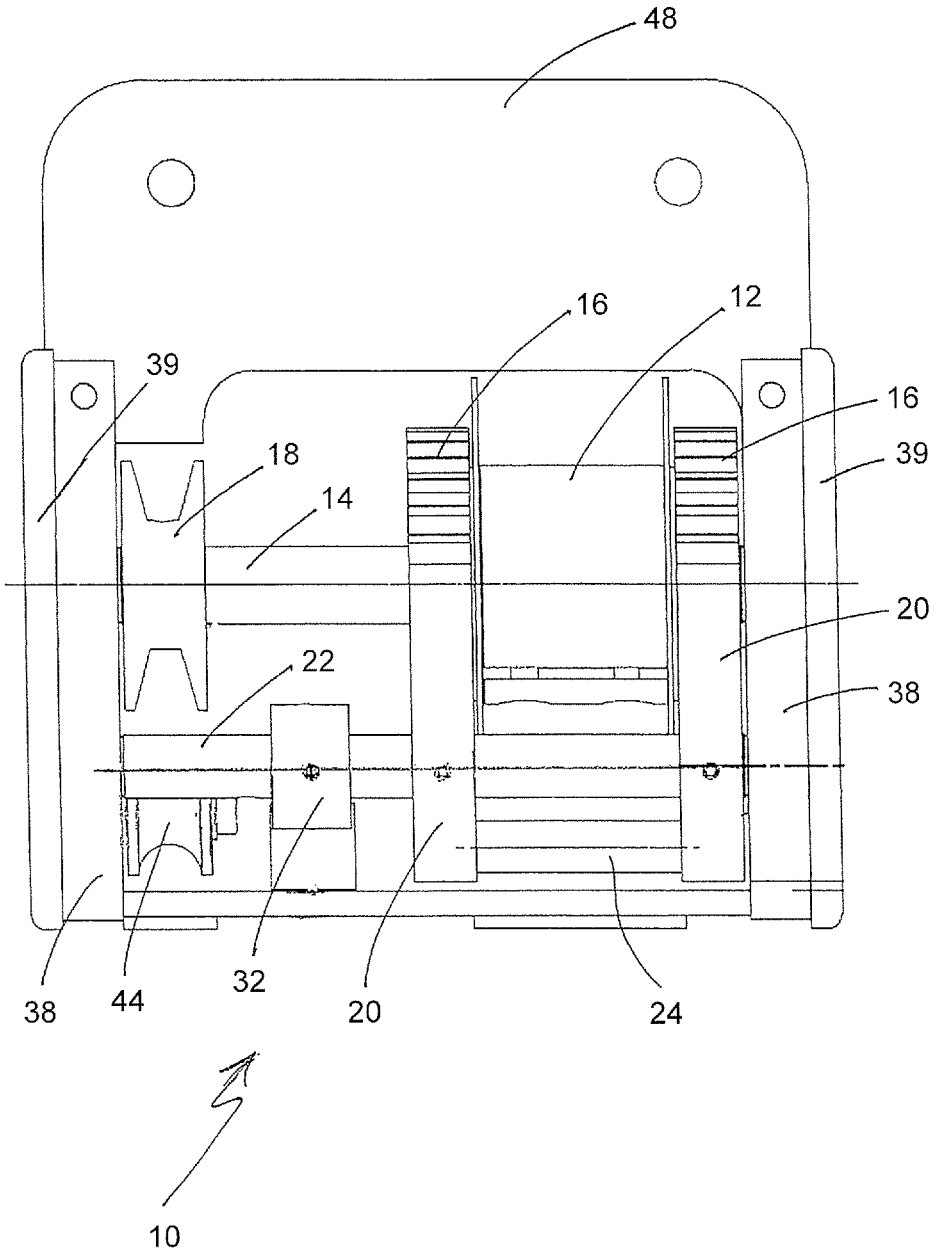
FIG. 5 is a rear view of the device of FIG. 1.
Figure 6:
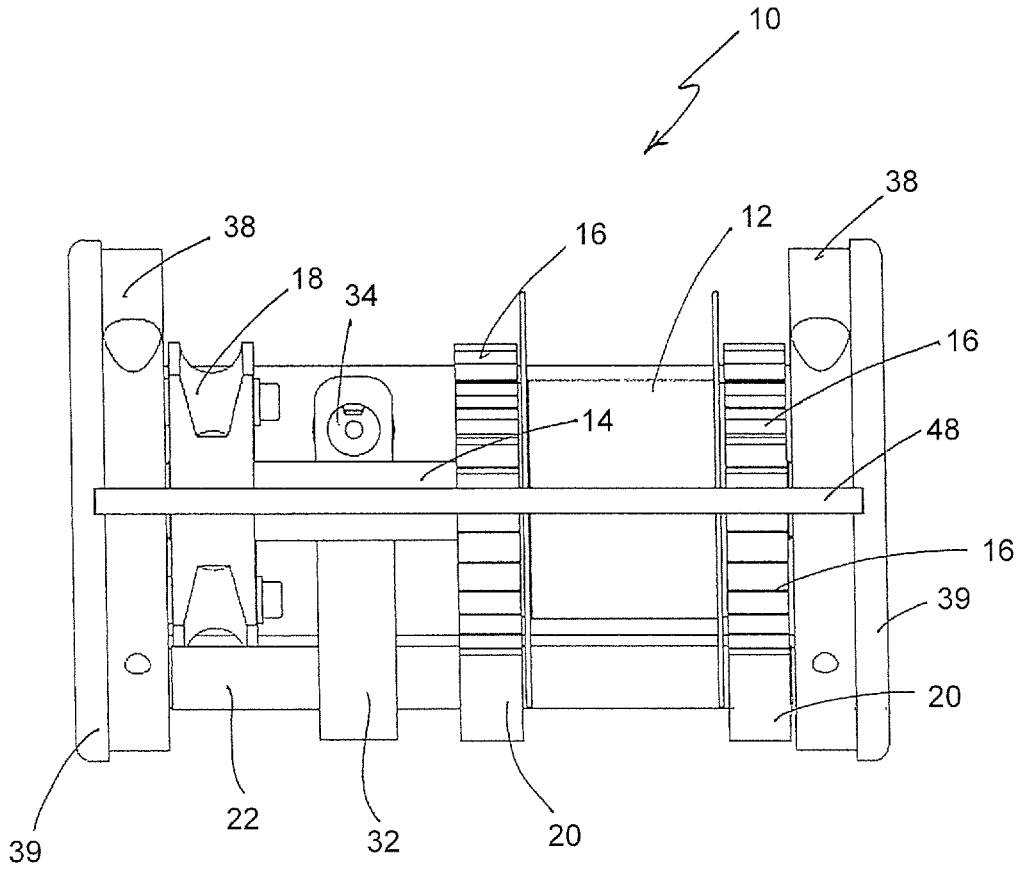
FIG. 6 is a top view of the device of FIG. 1.
Figure 7:
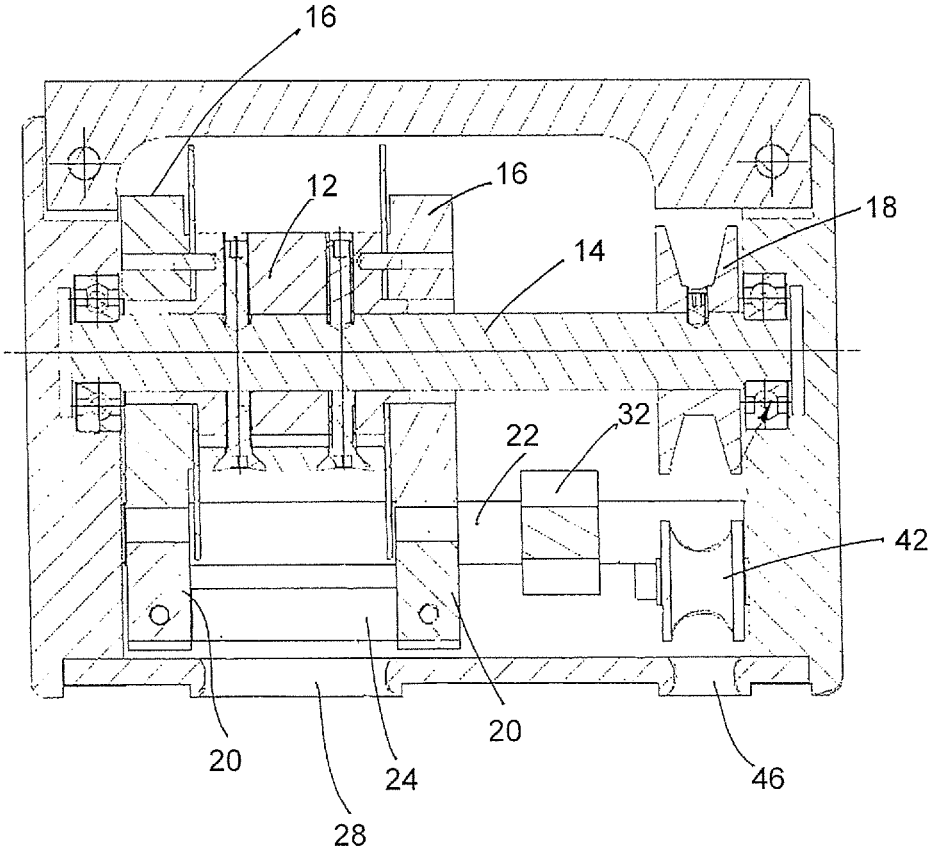
FIG. 7 is a cross-sectional view of the device of FIG. 1.

An embodiment of a weight bearing device 10 of the invention in the form of a trolley for being mounted overhead to a track secured to a ceiling is illustrated in the accompanying drawings. The side covers enclosing the internal workings of the device are not shown. As illustrated in FIGS. 1-8, the device 10 comprises a reel 12 mounted on a main shaft 14 between a pair of ratchet wheels 16. The main shaft defines a first axis of rotation. A pulley wheel 18 is fixedly mounted on one end of the main shaft for driving rotation of the main shaft as further described below. As also shown, a pair of pawls 20 are fixedly mounted on an ancillary shaft 22 which together with the ratchet wheels, form a locking mechanism of the device for locking rotation of the reel in use of the device as also further described below. The ancillary shaft 22 defines a second axis of rotation. Lower ends of the pawls 20 are connected together by an actuator element in the form of an actuator shaft 24 on which the pawls are mounted as best shown in FIGS. 4 and 5. In use, the actuator shaft pivots about the ancillary shaft 22. The operation of the device is best described with reference to FIG. 1.

Figure 1:
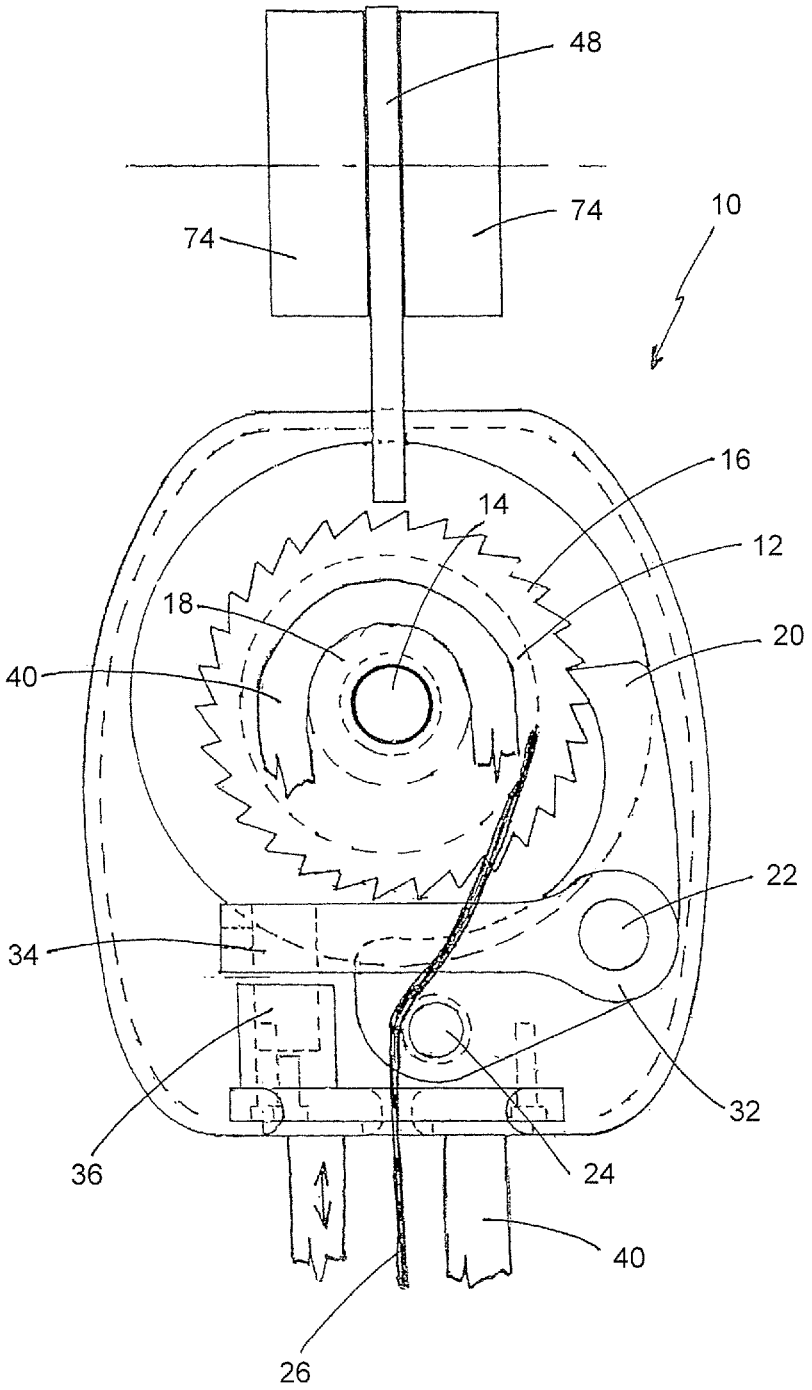
FIG. 1 is a schematic end view of a weight bearing device partially illustrating the support belt and pulley belt when fitted to the device.

As shown in FIG. 1, in use of the device 10, a support belt 26 for supporting the weight of a person is wound about the reel 12. The support belt hangs from the reel, wraps about the actuator shaft 24 and passes through a corresponding slot 28 formed in the bottom plate 30 of the device (see FIG. 3). The end of the support belt on the reel is fixed to the core of the reel. When weight is applied to the hanging end of the support belt 26, a force is applied to the actuator shaft 24 by the support belt which drives the actuator shaft about the ancillary shaft 22. This rotation of the actuator shaft about the ancillary shaft in turn drives the pawls into engagement with the teeth of the ratchet wheels 16, locking the reel 12 against rotation and thereby preventing unwinding of the support belt 26 from the wheel whereby the weight of the applied load is supported by the support belt.

To avoid or minimise the pawls ramming into engagement with the ratchet wheels and so causing jolting, wear and damage to the device, the device 10 is further provided with a damping system for damping the engagement of the pawls 20 with the ratchet wheels 16. In particular, in the embodiment illustrated in FIG. 1, the damping system comprises a lever arm 32 fixedly mounted on the ancillary shaft 22 and a pair of permanent magnets 34 and 36. Permanent magnet 34 is disposed on one end of the lever arm and as the ancillary shaft is rotated with the rotation of the pawls 20 in use, the lever arm is concomitantly rotated about the main shaft, whereby the permanent magnet 34 is moved into a magnetically repelling relationship with permanent magnet 36 which is mounted in a fixed position. The magnetic repulsion between the permanent magnets thereby biases the lever arm 32 against rotation in a working position in which the pawls 20 are in engagement with the ratchet wheels and so "smooths" the engagement of the pawls with the ratchet wheels.

When the weight applied to the support belt 26 is removed, the magnetic repulsion between the magnets 34 and 36 is sufficient to drive the magnets apart. This rotates the lever arm 32 back about the ancillary shaft 22 causing the ancillary shaft to rotate in an opposite direction whereby each pawl is withdrawn from engagement with its corresponding ratchet wheel. With the disengagement of the pawls, the reel 12 is free to rotate. The support belt 26 can then be raised or lowered in the absence of the load on the belt.

In at least some embodiments, the position of the permanent magnet 34 and/or 36 can be adjustable to adjust the weight which needs to be applied to the support belt in order to drive the pawls 20 into engagement with the ratchet wheels 16. Typically, the "engagement weight" which needs to be exceeded before the pawls will engage with the ratchet wheels is set at about 500 grams which allows for the free weight of a length of the support belt to hang from the reel and a coupling component fitted to the free end of the belt (as described further below), as well as a predetermined weight margin.

Each end of the main shaft 14 is rotatably mounted to a corresponding end plate 38 as illustrated in FIG. 8. The ancillary shaft 22 is likewise rotatably mounted to the end plates. A respective end cover 39 is fitted to each end plate. The side covers (not shown) enclosing the internal workings of the device are secured in position to each side of the device so as to fit over the sides of the end plates 38. The side covers together with the end plates 38 and the bottom plate 30 thereby form a housing of the device 10.

As again illustrated in FIG. 1, to raise or lower the support belt, an endless pulley belt 40 is looped about the pulley wheel 18 and passes around guide pulleys 42 and 44 before passing out through the slot 46 provided in the bottom plate 30 of the device. The pulley belt only extends from the device a limited distance to avoid possibility of entanglement with that belt, but generally is of a sufficient length to hang from the device 10 to enable the pulley belt to be 40 to be readily reached and gripped by the intended user.

Further, to minimise the risk of strangulation or self-harm, the pulley belt typically has a breaking strain rating in range of from 25-45 kg and more usually 35-45 kg, and so is designed to snap in the event weight exceeding the predetermined limit is applied to the pulley belt. In other embodiments, the pulley belt 40 may include a coupling mechanism which joins opposite ends of the belt together but which separates to break the coupling when the breaking strain of the belt is exceeded.

Thus, raising or lowering the support belt to a desired height in the absence of a load being applied to the support belt is simply a matter of pulling one side of pulley belt 40 in the appropriate direction. The pulley belt can be any type of belt deemed suitable, and the term "pulley belt" is to be taken in its broadest sense to include any length of material which functions to drive rotation of the pulley wheel. The pulley belt can, for instance, be in the form of a cord, cable or chain. In at least some embodiments, the pulley belt can be a beaded cord or chain. In this instance, corresponding depressions may be provided around the pulley wheel in which the beads of the cord or chain lie to provide purchase between the cord and the pulley wheel for rotation of the pulley wheel when the cord/pulley belt is pulled as is conventionally known in roller blind and roller shade arrangements. In at least some embodiments, the pulley belt can be fabricated from a silicone or other synthetic material such as polyurethane, including embodiments in which the pulley cord is a beaded cord as described above. Fabrication of the pulley cord entirely from a silicone compound or other synthetic polymer material is desirable as it can have good hand feel whilst at the same time provide for ease of cleaning and thereby cleanliness and good hygiene.

In embodiments in which the pulley belt is a beaded chain of the general type as described above the belt may, for instance, be a beaded metal chain.

Likewise, the support belt 26 can be any type of belt deemed suitable and may, for example be a flat strip of material or webbing, or a strap, cord, chain, cable or wire, which performs the intended purpose of the support belt. Typically, the support belt is a strip of woven webbing such as is commonly used for automotive restraints, harnesses and seatbelts, e.g., commercially available woven polyester, nylon or polypropylene webbing, or webbing fabricated from other suitable synthetic material(s). As the device 10 of the invention may be utilised to lift the full weight of a person, the support belt must be strong enough to do this without snapping. Generally, in embodiments of the invention, the support belt 26 will have a "safe load" breaking strain of 300 kg or 350 kg or more. Depending on the selected material from which the support belt 26 is fabricated, in some embodiments the breaking strain of the support belt may even be up to 1 tonne or greater, and even up to 2 tonnes or more.

Further, the support belt in particularly preferred embodiments is also desirably essentially non-stretchable under normal working loads applied to the support belt in use.

The support belt is of a length sufficient to allow the support belt to be unwound from the reel 12 by rotation of the pulley belt 40 to a suitable height for coupling of a belt of a load bearing element in the form of a hoist to the support belt for physically raising or lifting of a person by the hoist when operated to climb its extended belt as conventionally known. Suitable such electrically powered hoists for this purpose are well known in the field of care of aged, ill, infirm and incapacitated persons, and any such hoist may be employed in combination with a device embodied by the invention. As will be understood, to raise or lift a person with the use of a hoist, sling(s), belt(s), harness(es), yoke(s) and/or other aid(s) for holding the person are attached to the hoist. The hoist is then operated when the person is secured in the sling(s) or by the particular lifting aids utilised, to raise or lift the person. As will be understood, the reel 12 of the device 10 locks against rotation by engagement of the pawls 20 with the ratchet wheels 16 so the support belt is held against extension from the device, once the additional weight of the hoist applied to the support belt 26 exceeds the engagement weight for operation of the pawls. As with the support belt 26, the belt of the hoist can be a length of woven webbing, or e.g., a line, cord, cable, wire or the like suitable for purpose.

Figure 2:
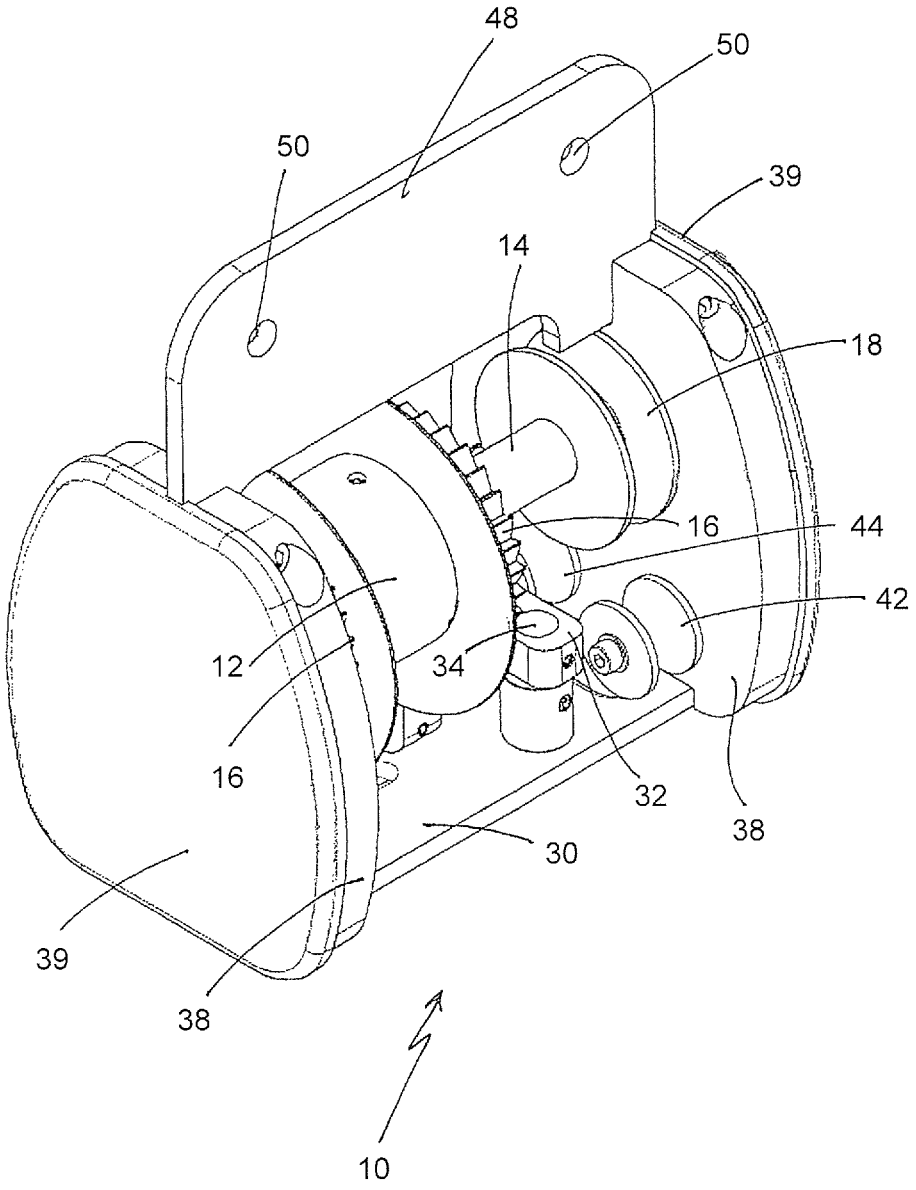
FIG. 2 is a view of the front of the device of FIG. 1 from above.
Figure 3:
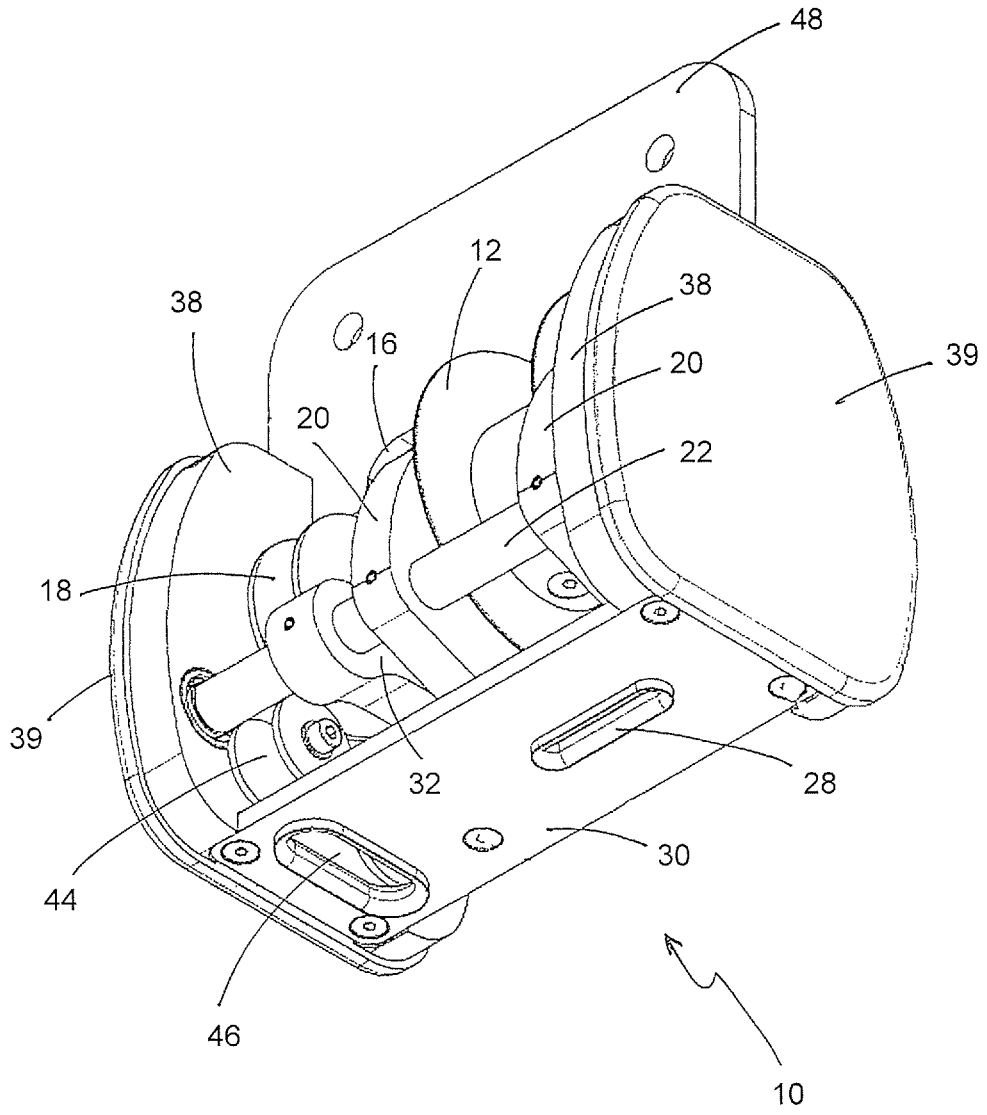
FIG. 3 is a view of the rear of the device of FIG. 1 from below.

As further illustrated in FIGS. 1-3, the device 10 is provided with an upright mounting bracket 48 with through holes 50 for the mounting of two pairs of rollers 74 to the bracket, one pair behind the other (see FIG. 1). As will be understood, the device can be slid onto the spaced apart flanges of a track secured to the ceiling, whereby the device is able to be rolled along the track on the rollers as needed. Whilst the provision of dual pairs of rollers 50 is desirable for stability of the device on the track, other roller arrangements and roller wheel configurations are possible, and all such arrangements and configurations are expressly encompassed by the invention.

In other embodiments, rather than being in the form of a trolley as described above, a device in accordance with the invention can be configured for being mounted overhead in a stationary position on a ceiling or suitable frame or stand for use of the device. In such instances, a modified form of the mounting bracket 48 can be utilised, or the mounting bracket 48 may not be provided and the device can be provided with other mounting(s) for securing of the device to the support.

For the purpose of coupling the support belt 26 to a hoist or other load bearing element as described above, a coupling component can be provided on the free end of the support belt for coupling of the load bearing element to the support belt. Any appropriate coupling system for connecting the load bearing element to the support belt can be employed. For instance, the coupling component fitted to the belt can be a carbine type connector with a spring-loaded gate, for reception of a buckle, hook, or closed loop fitting or other connector provided on the belt of the hoist, or vice versa. In particularly preferred embodiments, the coupling component fitted to the support belt 26 of the device of the invention mates with the connector of the hoist. The selected coupling component can be fitted or retrofitted to the support belt whilst the device is mounted in position in situ with the support belt fitted to the reel of the device. Alternatively, the support belt can be provided separately from the device and the coupling connector fitted to the free end of the support belt before the belt is fitted to the reel of the device.

Other load bearing elements besides hoists that can be used in combination with a device embodied by the invention include bars, handles (e.g., conventional triangle handles), straps and other attachments for being grasped by a person in e.g., bed to provide support to assist the person to reposition him or herself into a reclined or seated position such as may be necessary or desirable for undergoing an examination by a physician, or for eating, reading, conversing with visitor(s), or watching television from bed. Desirably, such load bearing elements are sufficiently heavy themselves when attached to the support strap to cause the reel of the device to be locked against rotation by operation of the pawls of the device.

In the above described embodiments, permanent magnets 34 and 36 are employed to bias the lever arm 32 against rotation to its working position to thereby dampen the rotation of the pawls 20 into engagement with the ratchet wheels 16. However, other damping means than permanent magnets can be used for this purpose. For instance, spring arrangements can be utilised in which one or more compression and/or tension springs can be arranged to bias the lever arm against rotation to its working position when weight is applied to the support belt 26 in use. As an example, one end of a tension spring can be connected to the lever arm and an opposite end of the spring can be connected to a stationary point of the device 10, so that the spring stretches to apply a biasing force to the lever arm against rotation to its working position, and which rotates the lever arm back to its initial resting position when the weight of the load is removed to the support belt. However, springs and other biasing means which could be used such resilient bands tend to lose their elasticity and prone to damage and wear over time. For these reasons, the use of permanent magnets to bias the lever arm 32 against movement into its working position is preferred.

Further, whilst the ratchet wheels 16 are shown as separate components to the reel 12 in the accompanying drawings, in other embodiments the ratchet wheels can be integrally formed with the reel or can, for example, form the side walls of the reel.

In still further embodiments, a weight bearing device in accordance with the invention can be locked in position on an overhead rail or other overhead support (e.g., a support frame) to provide a fixed support point that does not move. In preferred such embodiments, the device may be unlocked for being moved, slid or rolled along the rail or support and locked in position at a new location on the rail or support as required.

Indeed, a device embodied by the invention may be used in a range of different ways and for different purposes. For example, the device may be locked in a stationary overhead position above a patient on a operable bed or trolley or the like, for securing of the patient to the support belt of the device by harness(es), sling(s) and/or other lifting aids in the absence of a hoist. The bed or trolley can then be lowered whereby the person remains supported over the bed or trolley by the device. The device may then be unlocked from the overhead rail or support and moved along the rail/support away from the bed or trolley for changing of bedsheets, toileting, attendance to pressure care, or other requirements. Likewise, in instances where the device is retained overhead in a fixed position, the bed or trolley can be lowered and removed from under the patient whilst the patient remains suspended supported by the support belt of the device. As will be understood, the patient is then returned to a bed or trolley by relocating the bed or trolley under the patient, and the bed or trolley is raised to take the weight of the patient to allow the patient to be uncoupled from the support belt 26 of the device. In doing so, the patient can also be repositioned on the bed or trolley as may be required.

This method may also be used in a morgue or funeral parlour to assist with moving the body of a deceased person.

Hence, a device in accordance with the invention may be used as a standalone weight bearing device without the need for connection of a hoist to the support belt of the device.

In still further embodiments, the support belt 26 of a device of the invention can be mounted to an overhead rail and a strap of walking sling connected to the belt to support a patient during gait/walking training for therapy following e.g., injury or stroke. In this instance, the device may be drawn along the rail by the patient as they walk and provide support for the patient against falling.

Other uses of a device embodied by the invention include locating the device over a walking race or treadmill wherein a patient is supported by the device via a walking sling. Likewise, the device could be used to support therapy bolsters or other therapeutic, rehabilitation or exercise equipment requiring support from above, and all such uses of a device as described herein are expressly encompassed.

From the above, it will be understood that embodiments of the invention may provide one or more of the following advantages:

- Ready mounting of the device to an overhead fixture or support, or to an existing track system;
- Ready raising and lowering of the support belt of the device to a desired height;
- Provision of secure support for loads over a large weight range;
- Use of the device with commercially available hoist systems;
- A compact design;
- Essentially instantaneous locking of the reel 12 against rotation when the weight of the load is applied to the support belt 26 of the device; and
- Automatic unlocking of the reel 12 when the weight of the load is removed from the support belt.

Although a number of embodiments of the invention have been described above it will be understood that various modifications and changes may be made thereto without departing from the scope of the invention. The above described embodiments are therefore only illustrative and are not to be taken as being restrictive.

The invention claimed is:

1. A weight bearing device for being located overhead to support the weight of a load applied to the device in use, the device comprising:

a support belt for supporting the weight of the load;

a reel for winding up or unwinding the support belt, the reel being rotatable about a first axis of rotation to obtain a desired length of said support belt hanging from the reel for the application of the load to the support belt;

a locking mechanism for locking the reel against rotation about the first axis of rotation and thereby unwinding of the support belt; and an actuator element for driving the locking mechanism to lock the reel against said rotation about the first axis and thereby retain the length of the support belt hanging from the reel at the desired length, wherein the support belt wraps around one side of the actuator element for swinging the actuator element about a second axis of rotation to drive the locking mechanism to lock the reel against said rotation about the first axis upon the weight of the load being applied to the support belt, the first axis of rotation and the second axis of rotation being offset with respect to one another and wherein the locking mechanism is arranged to release the reel with return movement of the actuator element about the second axis of rotation when the weight of the load is removed from the support belt.

2. The device according to claim 1, further comprising:

a pulley wheel for being rotated to drive rotation of the reel to wind up or unwind the support belt in the absence of the weight of the load being applied to the support belt; and a pulley belt passing about the pulley wheel and arranged for being pulled to drive the rotation of the pulley wheel.

3. The device according to claim 2, wherein the first axis of rotation is defined by a rotatably mounted main shaft, and wherein the reel and the pulley wheel are fixedly mounted on the main shaft.

4. The device according to claim 1, further comprising a damping system for damping the locking of the reel by the locking mechanism, and wherein the damping system is configured to drive disengagement of the locking mechanism to permit rotation of the reel for unwinding of the belt from the reel[,] when the weight of the load is removed from the support belt.

5. The device according to claim 1, wherein the locking mechanism comprises:

at least one ratchet wheel arranged to rotate about the first axis of rotation with the rotation of the reel; and at least one pawl pivotable about the second axis of rotation into engagement with the ratchet wheel to lock the reel.

6. The device according to claim 5, further comprising a damping system for damping the engagement of the ratchet wheel by the at least one pawl, and wherein the damping system is configured to drive disengagement of the pawl from the ratchet wheel when the weight of the load is removed from the support belt.

7. The device according to claim 6, wherein the damping system comprises a lever arm for being rotated in one direction about the second axis of rotation to a working position when the actuator element is driven swung about the second axis by the support belt, and the lever arm is biased against said rotation into its working position to thereby dampen the engagement of the ratchet wheel by the pawl.

8. The device according to claim 7, wherein the damping system further comprises a pair of permanent magnets for being moved relative to one another into a magnetically repelling relationship to bias the lever arm against rotation into its working position.

9. The device according to claim 8, wherein the one said magnet is disposed for being moved into the magnetically repelling relationship with the other one of the magnets with the rotation of the lever arm to generate magnetic repulsion between the magnets for driving the magnets apart to rotate the lever arm about the second axis of rotation in an opposite direction to release the pawl from engagement with the ratchet wheel upon the weight of the load being removed from the support belt.

10. The device according to claim 9, wherein the one said magnet is mounted to the lever arm and the other one of the magnets is mounted in a fixed position.

11. The device according to claim 5, wherein the second axis is defined by a rotatably mounted ancillary shaft, and the pawl and the lever arm are fixedly mounted on the ancillary shaft.

12. The device according to claim 5, wherein the actuator element comprises an actuator shaft, and an end region of the at least one pawl is mounted to the actuator shaft for driving of the pawl about the second axis of rotation when the actuator shaft is swung about the second axis of rotation by the support belt upon the weight of the load being applied to the support belt.

13. The device according to claim 1, wherein the support belt includes a coupling component on a free end of the support belt for coupling of a load bearing element to the support belt.

14. The device according to claim 13, wherein the load bearing element is a hoist for facilitating raising or lifting a person or animal.

15. The device according to claim 1, wherein the device is configured for being mounted on an overhead track for movement of the device along the track.

16. The device according to claim 1, wherein the device further comprises one or more rollers for mounting on an overhead track to permit rolling of the device along the track on the one or more rollers.

17. The device according to claim 16, wherein the device comprises at least one pair of opposed said rollers.

18. The device according to claim 1, being for supporting a person or animal via the support belt.

19. A weight bearing device located overhead to support the weight of a load applied to the device in use, the device comprising:

a support belt for supporting the weight of the load;

a reel for winding up or unwinding the support belt, the reel being rotatable about a first axis of rotation to obtain a desired length of said belt hanging from the reel for the application of the load to the belt;

a locking mechanism for locking the reel against rotation about the first axis of rotation and thereby unwinding of the support belt; and an actuator element for driving the locking mechanism to lock the rotation of the reel against rotation about the first axis and thereby retain the length of the support belt hanging from the reel at the desired length, wherein the support belt wraps around one side of the actuator element for swinging the actuator element about a second axis of rotation to drive the locking mechanism to lock the reel against said rotation upon the weight of the load being applied to the support belt, and wherein the locking mechanism is arranged to release the reel with return of the actuator element about the second axis of rotation when the weight of the load is removed from the support belt, and the device is mounted on an overhead track for permitting movement of the device along the track.

20. A method for supporting a load, comprising:

providing a weight bearing device, the device being located overhead and having a support belt for supporting the load; a reel for winding up or unwinding the support belt, the reel being rotatable about a first axis of rotation to obtain a desired length of said belt hanging from the reel for the application of the load to the belt; a locking mechanism for locking the reel against rotation about the first axis of rotation and thereby unwinding of the support belt; and an actuator element for driving the locking mechanism to lock the rotation of the reel against rotation about the first axis and thereby retain the length of the support belt hanging from the reel at the desired length, wherein the support belt wraps around one side of the actuator element for swinging the actuator element about a second axis of rotation to drive the locking mechanism to lock the reel against said rotation upon the weight of the load being applied to the support belt, and wherein the reel is released by the locking mechanism upon the weight of the load being removed from the support belt; and applying the load to the support belt of the device.

21. The method according to claim 20, wherein the device is for supporting a person or animal via the support belt of the device.

22. The method of claim 20, wherein the step of applying the load to the support belt comprises coupling a load bearing element to the support belt.

23. The method of claim 22, wherein the load bearing element comprises a hoist for raising or lifting a person or animal.

* * * * *